United States Patent [19]

Kondo

[11] Patent Number: 4,474,100

[45] Date of Patent: Oct. 2, 1984

[54] MUSICAL KEYBOARD

[75] Inventor: Masao Kondo, Hamamatsu, Japan

[73] Assignee: Nippon Gakki Seizo Kabushiki Kaisha, Japan

[21] Appl. No.: 388,642

[22] Filed: Jun. 15, 1982

[30] Foreign Application Priority Data

Jun. 17, 1981 [JP] Japan ..... 56-89134[U]

[51] Int. Cl.[3] ..... G10C 3/12

[52] U.S. Cl. ..... 84/434

[58] Field of Search ..... 84/433–436

[56] References Cited

U.S. PATENT DOCUMENTS 2,565,239 8/1951 Kostka ..... 84/435

3,570,359 3/1971 Ohno ..... 84/436 X

*Primary Examiner*—Donald A. Griffin

*Attorney, Agent, or Firm*—Darby & Darby

[57] ABSTRACT

A musical keyboard includes a key bed having fulcrums formed therein, a row of keys each having a supported portion located at the rear end thereof for pivotal contact with the corresponding fulcrum for vertical swinging between a rest position and an operative position, and a resilient device for urging the keys upwards to said rest position. The resilient device has a leaf spring positioned below the keys and secured to the key bed to extend substantially horizontally towards the fulcrums, the free end of said leaf spring engaging the lower surface of each key to urge the key upwards.

14 Claims, 7 Drawing Figures

MUSICAL KEYBOARD

BACKGROUND OF THE INVENTION

The present invention relates to musical keyboards utilized in musical instruments such as electronic organs and the like.

A typical example of the conventional keyboard employed in the electronic organ is illustrated in FIG. 1, in which a reference numeral 1 indicates a natural or white key, the rear end 3 of which is connected to a supporting portion or fulcrum 5 of a key bed or key supporting frame 7 for pivotal contact with that fulcrum. The key 1 is urged to swing upwardly by a coil spring 9 which is held vertically between key bed 7 and a spring receiving portion 4 of key 1, and it is normally held in a rest or non-operative position by bringing a substantially L-shaped stopper 11 extending downwardly from key 1 into abutment with a stopper receiving member 13 of felt provided on the lower surface of key bed 7. With this arrangement, when key 1 is depressed, a key switch 15 which is mounted on a printed circuit board 17 is closed by making an actuator 19 extending downwardly from key 1 actuate it, whereby a musical note corresponding to the depressed key 1 is emitted by well known electronical means. The key bed 7 has further a guide member 21 struck out therefrom for preventing key 1 from moving laterally.

With the above prior art keyboard structure, the mounting of keys 1 on key bed 7 necessitates laborious fitting of coil spring 9 into a spring receiving portion 4 of each key 1. Furthermore, it is difficult to reduce the thickness of the keyboard since coil springs 9 are vertically disposed on key bed 7. The keyboard further needs an additional stopper 23 for each key 1 to prevent the coming off of that key 1 from key bed 7. This is because when key 1 is pulled while the rear end 3 thereof is depressed, coil springs 9 are compressed and fallen forward, so that the pivoted portion of key 1 can disengage from the fulcrum 5 of key bed 7.

Keyboards similar to the above described are disclosed for example in Japanese Utility Model Publication Sho54-29780 and Japanese Utility Model Preliminary Publication Sho52-141,928.

SUMMARY OF THE INVENTION

Accordingly, it is an object of the present invention to provide a keyboard in which keys and key-biasing springs are easily set up in the key bed, thereby enabling reduction in manufacturing cost and labor.

It is another object of the invention to provide a keyboard of which thickness is considerably reduced.

It is a further object of the invention to provide a keyboard in which key touch is improved.

With these and other objects in view the present invention will provide a musical keyboard comprising a key bed having fulcrums formed therein, a row of keys each having a supported portion located at the rear end thereof for pivotal contact with the corresponding fulcrum for vertical swinging between a rest position and an operative position, and resilient means for urging the keys upwards to the rest position. The resilient means includes a leaf spring positioned below the keys and secured to the key bed to extend substantially horizontally towards the fulcrums, the free end of the leaf spring engaging the lower surface of each key to urge that key upwards.

BRIEF DESCRIPTION OF THE DRAWINGS

While the specification concludes with claims which particularly point out and distinctly define the subject matter which is regarded as the invention, it is believed that the invention will be more clearly understood when considering the following detailed description and the accompanying drawings in which:

DETAILED DESCRIPTION OF THE PREFERRED EMBODIMENTS

Figure 1:
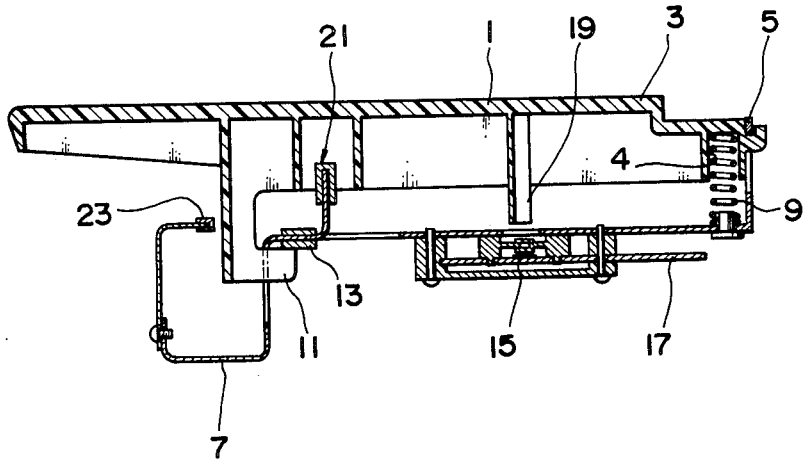
FIG. 1 Prior Art
FIG. 1 is a vertical section of one example of the prior musical keyboard.
Figure 2:
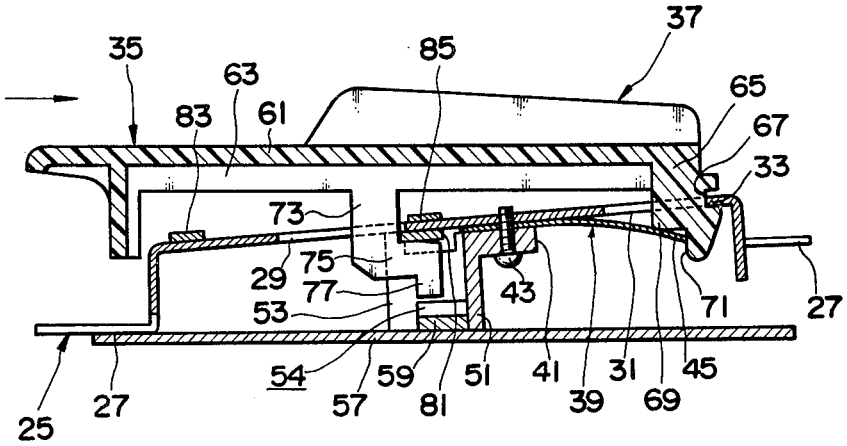
FIG. 2 is a vertical section of a keyboard constructed according to the present invention.
Figure 3:
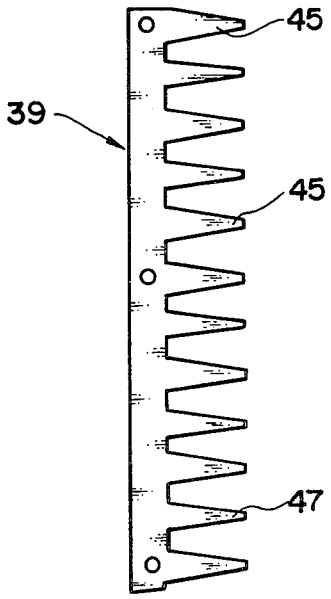
FIG. 3 is a fragmentary plan view of a comb-shaped leaf spring used in the key board in FIG. 2.

Referring to FIGS. 2 and 3, a reference numeral 25 designates a generally rectangular key bed for use in an electronic organ, the key bed 25 being fastened at its peripheral lugs 27 to a casing (not shown) of the electronic organ by means of machine screws and the like. The key bed 25 has many pairs of rectangular openings 29 and 31 formed in position therein. The rearside periphery 33 of the opening 31 forms a fulcrum on which a white key 35 or black key 37 is supported for vertical movement as will be described later. A comb-shaped leaf spring 39 is sandwiched between key bed 25 and a spring holding member 41 of an elongated plate and fastened to the lower surface of key bed 25 near opening 31 in a cantilever fashion by means of screws 43 so that the comb teeth thereof extend substantially horizontally toward the rear end of key bed 25. The leaf spring 39 may be formed from any suitable conventional spring material. In the embodiment shown in FIG. 3, the leaf spring 39 consists of large comb teeth 45 for white keys 35 and small comb teeth 47 for black keys 37, both teeth 45 and 47 being of an isosceles triangular shape and being equal in number to white keys 35 and black keys 37, respectively.

Figure 4:
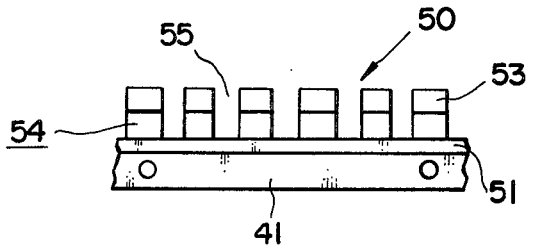
FIG. 4 is a bottom view of a key switch holder shown is FIG. 2.

As shown in FIGS. 2 and 4, the spring holding member 41 is integrally formed with a vertical wall 51 of a key switch holder 50 and extends horizontally therefrom. From the other side of the vertical wall 51 there extend vertically key guides 53 in an equi-spaced relationship, and as a result a key guide slot 55 is formed between the adjacent two key guides 53. The lower surface of each key guide 53 has a recess 54 formed therein. Onto the lower end of each guide 53 and the lower edge of vertical wall 51 there is fastened a printed circuit board 57 on which a key switch assembly 59 is mounted to fit in the recess 54 of guide 53. The respective key switches are arranged to be positioned at the guide slots 55 so as to be in the movement paths of key switch actuators 77 described below.

On the upper surface of key bed 25 there are arranged a certain number of white keys 35 and black keys 37 of thermoplastic material in a juxtaposed relationship. The white key 35 is of a generally inverted U-shaped cross-section and comprises a rectangular body 61, a pair of side walls 63 (only one of which is shown) extending downwardly from the opposite edges of that body 61, and a supported portion 65 extending vertically downwardly from the rear end of body 61. The supported portion 65 has a transverse groove 67 formed on the rearside thereof, the groove 67 being adapted for pivotal contact with fulcrum 33 for vertical swinging of key 35. On the lower side of supported portion 65, there is provided a shoulder 69 having a horizontal surface which serves as a spring receiving portion, the shoulder 69 terminating in a key lock 71 which extends vertically downward therefrom. At the mid-portion of each side wall 63 of the white key 35 there is provided a substantially L-shaped stopper 73 extending downwardly therefrom. One of the stoppers 73 on both side walls 63 is formed with a key switch actuator 77 which is thus located in the guide slots 55 (FIG. 4) to oppose a corresponding key switch. The black key 37 has a substantially similar construction to the white key 35 and hence explanation thereof is omitted.

In mounting leaf spring 39 and white key 35 or black key 37 on key bed 25, the base portion of the leaf spring 39 is interposed between key bed 25 held upside down and spring holding member 41 in a sandwich manner and then fastened by means of screw bolts 43, then the key bed 25 is placed as shown in FIG. 2. Next, a pair of stoppers 73 and the supported portion 65 of white key 35 or black key 37 are inserted into the corresponding openings 29 and 31, respectively and pushed backwards or in a direction indicated by the arrow shown in FIG. 2 to bring transverse groove 67 into engagement with pivot 33 for pivotal contact therewith, in which event the tip of each comb tooth 45 or 47 comes into abutment with key lock 71 after urged downwardly by the lower end of key lock 71. In this stage, the comb spring urges the shoulder 69 upwardly so that the key is biased upwardly, but is held in a rest or non-operative position by bringing legs 75 of stopper 73 into abutment against a stopper receiving member 81 of felt which is attached to the lower surface of key bed 25 in the vicinity of opening 29, the legs 75 being inserted into respective key guide slots 55 defined by the adjacent key guides 53.

In this embodiment, comb-shaped leaf spring 39 is employed in place of the coil spring as in the prior key board. This largely facilitates the attaching of the spring to key bed 25 and also the setting up of keys 35 and 37 to key bed 25 and can reduce the thickness of the whole instrument since leaf spring 39 can be disposed substantially horizontally. Furthermore, the free end of leaf spring 39 abuts against the key lock 71 of each key 35 or 37 and thereby keys are prevented from coming out of the key bed 25 when pulled forward.

In operation, white key 35 or black key 37 is depressed and swung downwardly against the spring 39 to a depressed or operative position where the lower edges of the side walls 63 of each key come into contact with a shock absorber 83 and 85 of felt which are applied on the upper surface of key bed 25 through adhesive, and the actuator 77 contacts simultaneously the corresponding key switch 59 to close a circuit and sound a tone electronically by conventional means (not shown). Then, the key 35 or 37 is released and allowed to return to its original position or non-operative position in FIG. 2 by the force of leaf spring 39.

Figure 5:
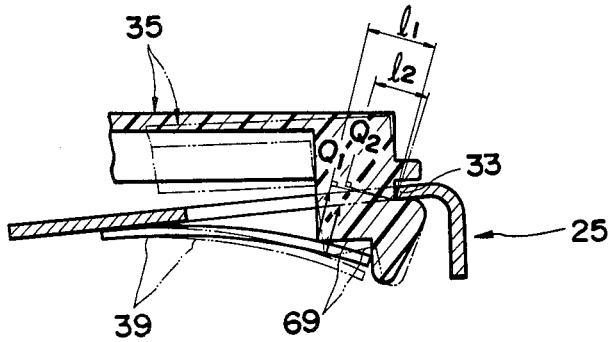
FIG. 5 is an explanatory view illustrating the operation of the key in FIG. 2.

Now, key touch of the present invention will be described with reference to FIG. 5. When the white key or black key is depressed from the non-operative position indicated by the solid line to an operative position indicated by a phantom line in FIG. 5, the deflection amount and angle of the tooth spring 45 or 47 are increased and the point of contact of shoulder 69 with that tooth spring moves toward the free end of the latter, with the result that the perpendicular line from fulcrum 33 to the line of action of force Q exerted by comb tooth 45 or 47 on shoulder 69 reduces from $l_1$ to $l_2$. Therefore the force $Q_2$ which is exerted from the comb tooth on key 35 or 37 when that key is in the operative position does not become too large as compared to the force $Q_1$ when it is in the non-operative position. Consequently, the rotation moment applied to that key by leaf spring 39 will not increase largely and thus the key touch feeling does not become heavier as the key is depressed, which is desirable in a keyboard musical instrument.

Figure 6:
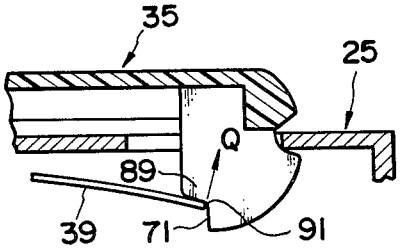
FIG. 6 is a fragmentary vertical section of a slightly modified key of FIG. 2.

In the above embodiment, the comb teeth 45 and 47 of leaf spring 39 abut at free ends against their respective key locks 71 of keys 35 and 37 and contact the shoulders near the free ends thereof to urge the keys 35 and 37 upwardly. However, as shown in FIG. 6, shoulder 89 may be formed to be inclined downwardly so that shoulder 89 and key lock 71 meet at corner 91 with a obtuse angle, thereby bringing the free end of tooth comb 45 or 47 into abutment with corner 91 to urge the key upwards. With this construction, there will be no possibility as in the previous embodiment that when a key is stroungly pulled forward in the state that it is in a depressed position as shown by the phantom line in FIG. 5, the free end of the corresponding comb tooth 45 or 47 is stucked into key lock 71 of that key and thus the key is prevented from returning to its original position when released.

Figure 7:
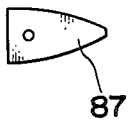
FIG. 7 is a plan view showing another embodiment of the leaf spring.

The leaf spring employed in the present invention is not limited to comb-shaped leaf spring 39, but may be a single leaf spring 87 of substantially an isosceles triangle as shown in FIG. 7 in which case leaf springs 87 equal in number to the white and black keys are used for a keyboard, and the base portion of each spring is fastened to key bed 25 is a cantilever fashion.

What is claimed is:

1. In a musical keyboard of the type which includes a frame means having fulcrums formed therein, a row of elongated keys each having a supported portion located at a rear end thereof for pivotal contact with a corresponding fulcrum of said frame means for vertical swinging between a rest position and an operative position and resilient means for urging the keys upwards to said rest position, the improvement wherein the resilient means comprises a leaf spring positioned below the keys and secured to the frame means to have a free end extend substantially horizontally towards the fulcrums, the free end of said leaf spring engages a lower surface of each said key to urge the key upwards, and wherein said supported portion extends downwardly from said rear end of the key, and said leaf spring engages at the free end the lower surface of the supported portion.

2. The musical keyboard as recited in claim 1, wherein the key comprises further a key lock projecting downwards from said lower surface of said supported portion, whereby the free end of said leaf spring abuts against said key lock to prevent a longitudinal movement of the elongated key.

3. The musical keyboard as recited in claim 1, wherein said supported portion is provided with a lateral groove engaging said fulcrum for pivotal contact therewith.

4. The musical keyboard as recited in claim 3, wherein the frame means is provided with an opening for passing said supported portion therethrough, a rear-side periphery of said opening forming said fulcrum, and wherein a fixed end of said leaf spring is fastened to the lower surface of the key bed.

5. The musical keyboard as recited in claim 4, wherein the key further comprises a generally L-shaped stopper extending downwardly from the key and having a horizontal leg, said horizontal leg normally engaging the frame means for holding the key in said rest position with the aid of said leaf spring.

6. The musical keyboard as recited in claim 5, further comprising an elongated key switch holder fastened to the lower surface of the frame means and having key guide means for guiding an up-down movement of said stoppers, and said horizontal leg having an actuator for actuating a key switch mounted on said key switch holder when the key is depressed.

7. The musical keyboard as recited in claim 6, wherein said key switch holder is provided with an elongated spring holding member integrally formed therewith and extending longitudinally of said key switch holder, said spring holding member fastening the fixed end of said leaf spring to the frame means in a sandwich manner.

8. In a musical keyboard of the type which includes a frame having fulcrums formed therein, a row of elongated keys each having a supported portion located at a rear end thereof for pivotal contact with a corresponding fulcrum of said frame means for vertical swinging between a rest position and an operative position and resilient means for urging the keys upwards to said rest position, the improvement wherein the resilient means comprises a leaf spring positioned below the keys and secured to the frame means to have a free end extend substantially horizontally towards the fulcrums, the free end of said leaf spring engaging a lower surface of each said key to urge the key upwards, and wherein said leaf spring is of a comb shape having teeth the number of which corresponds to the number of the keys, the free ends of said teeth engaging the respective keys.

9. The musical keyboard as recited in claim 8, wherein the key comprises further a key lock projecting downwards from said lower surface of said supported portion, whereby the free end of said leaf spring abuts against said key lock to prevent a longitudinal movement of the elongated key.

10. The musical keyboard as recited in claim 8, wherein said supported portion is provided with a lateral groove engaging said fulcrum for pivotal contact therewith.

11. The musical keyboard as recited in claim 10, wherein the frame means is provided with an opening for passing said supported portion therethrough, a rear-side periphery of said opening forming said fulcrum, and wherein a fixed end of said leaf spring is fastened to the lower surface of the key bed.

12. The musical keyboard as recited in claim 11, wherein the key further comprises a generally L-shaped stopper extending downwardly from the key and having a horizontal leg, said horizontal leg normally engaging the frame means for holding the key in said rest position with the aid of said leaf spring.

13. The musical keyboard as recited in claim 12, further comprising an elongated key switch holder fastened to the lower surface of the frame means and having key guide means for guiding an up-down movement of said stoppers, and said horizontal leg having an actuator for actuating a key switch mounted on said key switch holder when the key is depressed.

14. The musical keyboard as recited in claim 13, wherein said key switch holder is provided with an elongated spring holding member integrally formed therewith and extending longitudinally of said key switch holder, said spring holding member fastening the fixed end of said leaf spring to the frame means in a sandwich manner.

* * * * *